US006819348B2

(12) United States Patent
Tamura et al.

(10) Patent No.: US 6,819,348 B2
(45) Date of Patent: Nov. 16, 2004

(54) THERMAL TRANSFER FILM, PROCESS FOR PRODUCING THE SAME AND METHOD FOR IMAGE FORMATION USING SAID THERMAL TRANSFER FILM

(75) Inventors: Yoshihiko Tamura, Shinjuku-ku (JP); Kenichi Aso, Shinjuku-ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 10/238,878

(22) Filed: Sep. 11, 2002

(65) Prior Publication Data

US 2003/0137579 A1 Jul. 24, 2003

(30) Foreign Application Priority Data

Sep. 12, 2001 (JP) ..... 2001-277135
Sep. 26, 2001 (JP) ..... 2001-294378

(51) Int. Cl.[7] ..... B41J 2/325
(52) U.S. Cl. ..... 347/217
(58) Field of Search ..... 347/217, 105, 347/204; 428/32.63, 195; 430/200

(56) References Cited

U.S. PATENT DOCUMENTS 5,019,452 A * 5/1991 Watanabe et al. ..... 428/32.63
2001/0004485 A1 * 6/2001 Takahashi et al. ..... 428/195
2002/0086232 A1 * 7/2002 Nirmal et al. ..... 430/200

FOREIGN PATENT DOCUMENTS

| | | | |
|---|---|---|---|
| EP | 0 034 376 A2 | 8/1981 | |
| JP | 62-233290 | 10/1987 | |
| JP | 61-258791 | 11/1988 | |
| JP | 3-275388 | 12/1991 | |
| JP | 7-205460 | 8/1995 | |
| JP | 11091232 A * | 4/1999 | ..... B41M/3/06 |

* cited by examiner

*Primary Examiner*—K. Feggins
(74) *Attorney, Agent, or Firm*—Parkhurst & Wendel, L.L.P.

(57) ABSTRACT

There are provided a thermal transfer film which can yield a thermally transferred print possessing excellent fastness or resistance properties such as excellent abrasion resistance, lightfastness, and alteration preventive property, is less likely to cause damage to an object, is free from a deterioration in quality of the print, and does not incur an increase in production cost, a method for image formation using the thermal transfer film, and an image formed object. The thermal transfer film according to the present invention comprises a substrate and one or a plurality of layers including a thermal transfer layer provided on one side of the substrate, the thermal transfer layer being located on the uppermost surface of the thermal transfer film, a convex being provided on a part of the thermal transfer layer.

13 Claims, 3 Drawing Sheets

THERMAL TRANSFER FILM, PROCESS FOR PRODUCING THE SAME AND METHOD FOR IMAGE FORMATION USING SAID THERMAL TRANSFER FILM

BACKGROUND OF THE INVENTION

1. Field of the Invention

The present invention relates to a thermal transfer film and particularly to a thermal transfer film which can yield a thermally transferred print possessing excellent fastness or resistance properties such as excellent abrasion resistance, lightfastness, and alteration preventive property, is less likely to cause damage to an object, is free from a deterioration in quality of the print, and does not incur an increase in production cost, a process for producing the thermal transfer film, a method for image formation using the thermal transfer film, and an image formed object.

2. Prior Art

Thermal transfer can easily record variable information and thus is extensively used in a wide variety of applications. The thermal transfer is a method which comprises the steps of: putting a thermal transfer film, comprising a colorant layer provided on a substrate, on top of an object optionally provided with a receptive layer; pressing the assembly between a heating device, such as a thermal head, and a platen roll; and selectively heating the heating device in its heating portion according to image information to transfer the colorant contained in the colorant layer on the thermal transfer film onto the object, whereby an image is recorded on the object. Thermal transfer methods are roughly classified into thermal ink transfer (hot melt-type thermal transfer) and thermal dye sublimation transfer (sublimation-type thermal transfer).

The thermal ink transfer is a method for image formation wherein a thermal transfer film bearing thereon a heat-fusion ink layer is heated by the above heating means and the component of the softened heat-fusion ink layer is transferred onto an object such as natural fiber paper or plastic sheet to form an image. The heat-fusion ink layer used herein is formed of a dispersion of a colorant, such as a pigment, in a binder, such as heat-fusion wax or resin and is supported on a substrate such as a plastic film. The formed image has high density and high sharpness, and this method is suitable for recording binary images such as characters and line drawings.

On the other hand, the thermal dye sublimation transfer is a method for image formation wherein a thermal transfer film bearing thereon a sublimable dye layer is heated by the above heating means to sublimate and transfer the sublimable dye contained in the dye layer onto a receptive layer provided on an object, whereby an image is formed on the object. The sublimable dye layer used herein is formed of a solution or dispersion of a sublimable dye used as the colorant in a binder resin and is supported on a substrate film such as a plastic film. According to this method, since the amount of the dye transferred can be regulated dot by dot according to the quantity of energy applied to a heating device, such as a thermal head, the reproduction of gradation can be realized by varying the density.

Thus, the thermal ink transfer method and the thermal dye sublimation transfer method have respective features, that is, the thermal ink transfer method can easily and clearly form images of characters, numerals and the like, while the thermal dye sublimation transfer method is excellent in gradation rendering and can form images such as a photograph-like image of a face in a faithful, clear manner.

Images formed by the above thermal transfer methods, independently of whether the images have been formed by the thermal ink transfer method or the thermal dye sublimation transfer method, are unsatisfactory in fastness or resistance properties such as abrasion resistance, lightfastness, and alteration preventive property. To cope with the unsatisfactory fastness or resistance properties, a protective layer has hitherto been formed on the image. For example, Japanese Patent Laid-Open No. 159795/1991 describes that information such as images and letters are formed on a card substrate and a transparent protective layer is provided on at least a part of the surface of the information. In this case, two or more protective layers are transferred so that they overlap with each other and are different from each other in transfer area. At least one of the protective layers contains a brightening agent and/or an ultraviolet absorber. In this method, however, since the transfer of the protective layer is carried out twice or more, damage to the object is large. Further, the number of steps (transfer) necessary for preparing a print is large, and a great deal of time is required. Therefore, for example, a deterioration in print quality and an increase in production cost are disadvantageously likely to occur.

Japanese Patent Laid-Open No. 177249/2000 describes a record produced by forming a color image on recording paper and forming a transparent image of a transparent ink on the color image and further discloses that an overcoat is formed between the color image and the transparent image. The claimed advantage of the record is to improve the weathering resistance and abrasion resistance of the color image and to permit the transparent image on the color image to be viewed by the reflection of light according to the angle of the line of sight to the transparent image recorded face. Also in this case, however, since the transfer onto the color image on the recording paper is carried out a plurality of times, that is, since the transparent image and the overcoat are transferred onto the color image on the recording paper, damage to the object is large. Further, the number of steps (transfer) necessary for preparing a print is large, and a great deal of time is required. Therefore, for example, a deterioration in print quality and an increase in production cost are disadvantageously likely to occur.

SUMMARY OF THE INVENTION

The present invention has been made with a view to solving the above problems of the prior art, and it is an object of the present invention to provide a thermal transfer film which can yield a thermally transferred print possessing excellent fastness or resistance properties such as excellent abrasion resistance, lightfastness, and alteration preventive property, is less likely to cause damage to an object, is free from a deterioration in quality of the print, and does not incur an increase in production cost, a method for image formation using the thermal transfer film, and an image formed object.

The above object can be attained by a thermal transfer film comprising: a substrate; and one or a plurality of layers including a thermal transfer layer provided on one side of the substrate, the thermal transfer layer being located on the uppermost surface of the thermal transfer film, a convex being provided on a part of the thermal transfer layer.

According to a preferred embodiment of the present invention, the thermal transfer layer comprises mainly of a thermoplastic resin having a glass transition temperature of 50 to 120° C. The use of this resin can provide good transferability and fixation onto an object.

More preferably, the thermoplastic resin is selected from a polyester resin having a number average molecular weight of 2000 to 30000, a vinyl chloride-vinyl acetate copolymer having an average degree of polymerization of 150 to 500, and a homopolymer or copolymer, of a methacrylate base monomer, having a weight average molecular weight of 20000 to 60000. The use of this resin can improve the function of the thermal transfer layer, after transfer onto the object, as the protective layer, that is, can improve fastness or resistance properties such as abrasion resistance, lightfastness, and alteration preventive property.

In another embodiment of the thermal transfer film according to the present invention, a release layer is provided between the substrate and the thermal transfer layer, and the release layer is not separable from the substrate side. The provision of the release layer can improve the transferability of the thermal transfer layer.

Preferably, a peel layer is provided between the substrate and the thermal transfer layer, and the peel layer is separable from the substrate side. The provision of the peel layer can improve transferability because, in transfer onto an object, the thermal transfer layer, together with the peel layer, is transferred from the thermal transfer film.

More preferably, the peel layer is provided between the release layer and the thermal transfer layer. This facilitates the transfer of the thermal transfer layer together with the peel layer onto an object.

In the thermal transfer film according to the present invention, preferably, the convex provided in the thermal transfer layer has a height of 0.2 to 5.0 $\mu$m. When the height of the convex is in the above-defined range, the convex in the thermal transfer layer transferred onto the object becomes easily legible by the reflection of light according to the angle of the line of sight to the transfer face.

According to another aspect of the present invention, there is provided a process for producing a thermal transfer film, said process comprising the steps of: providing two thermal transfer films each comprising a substrate and one or a plurality of layers including a thermal transfer layer provided on the substrate, the thermal transfer layer being located on the uppermost surface of the thermal transfer film; putting the two thermal transfer films on top of each other so that the thermal transfer layer in one of the thermal transfer films faces the thermal transfer layer in the other thermal transfer film; and partially heating the assembly of the thermal transfer films to transfer a part of the thermal transfer layer in one of the thermal transfer films onto the thermal transfer layer in the other thermal transfer film, whereby a convex is formed on a part of the thermal transfer layer in one of the thermal transfer films. The thermal transfer layer in the thermal transfer film comprising a thermal transfer layer having a convex in a part thereof provided on one side of the substrate at a position most remote from the substrate is transferred onto an object. For example, an image is previously provided by the thermal transfer recording or the like on the object onto which the thermal transfer layer is transferred, and the thermal transfer layer is transferred onto the image. This can protect the image and permits the convex in the thermal transfer layer transferred onto the object to be legible by the reflection of light according to the angle of the line of sight to the image recorded face.

According to still another aspect of the present invention, there is provided a method for image formation using the thermal transfer film according to the present invention, said method comprising the steps of: putting the thermal transfer film on top of a thermal transfer recording medium comprising a substrate and, provided on at least one side of the substrate, a thermal transfer ink layer comprising a thermoplastic resin and a colorant so that the thermal transfer layer faces the thermal transfer ink layer; imagewise heating the stacked thermal transfer recording medium to imagewise transfer the thermal transfer ink layer or the colorant onto the thermal transfer layer in the thermal transfer film, whereby a reverse image is once formed on the thermal transfer film; then putting the thermal transfer film with the reverse image formed thereon on top of an object so that the thermal transfer layer in the thermal transfer film faces an image forming face in the object; and heating the stacked thermal transfer film from the surface thereof remote from the thermal transfer layer to transfer the thermal transfer layer with the reverse image formed thereon onto the object, whereby an image is formed on the object.

Further, the thermal transfer layer is preferably transparent or translucent. According to this construction, even when the convex in the thermal transfer layer overlaps with the image of the thermal transfer ink layer, the image can be clearly viewed because the convex and the image do not affect each other.

More preferably, the light transmission properties of the convex in the thermal transfer layer are different from those of the portion other than the convex in the thermal transfer layer. This can render the convex in the thermal transfer layer conspicuous.

According to a further aspect of the present invention, there is provided an image formed object (a thermal transfer print) comprising an image formed on an object by the above method for image formation. In the image formed object produced by this method, the image formed by the transfer of the thermal transfer ink layer is protected by a transparent or translucent thermal transfer layer and thus possesses excellent fastness or resistance properties such as abrasion resistance, lightfastness, and alteration preventive property. Further, the convex in the thermal transfer layer transferred onto the object is legible by the reflection of light according to the angle of the line of sight to the image recorded face of the image formed object.

Further, the thermal transfer film, wherein the thermal transfer layer having a convex in a part thereof is provided on one side of the substrate at its position most remote from the substrate and an image has been formed by the transfer of the thermal transfer ink layer from the thermal transfer recording medium provided with the thermal transfer ink layer, can function as an intermediate transfer recording medium, and a thermal transfer layer as a protective layer and a convex can be formed on the object by a single transfer operation. Therefore, this can reduce damage to the object caused by the transfer and can suppress a deterioration in image quality and an increase in production cost.

DETAILED DESCRIPTION OF THE INVENTION

At the outset, preferred embodiments of the thermal transfer film according to the present invention will be described in detail with reference to the accompanying drawings.

Figure 1:
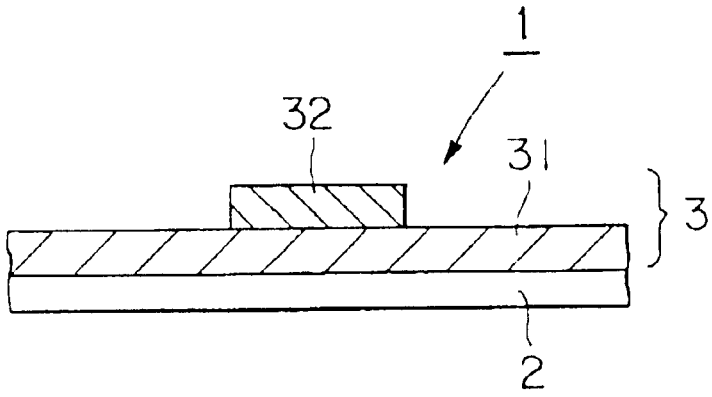
FIG. 1 is a cross-sectional view showing one embodiment of the thermal transfer film according to the present invention.

FIG. 1 is a cross-sectional view showing one embodiment of a thermal transfer film 1 according to the present invention. In the thermal transfer film 1, a thermal transfer layer 31 and a thermal transfer layer 32 are stacked on a substrate 2. The thermal transfer layer 32 is in a convex form and is located at a position most remote from the substrate 2. The thermal transfer film 1 shown in FIG. 1 is put on top of an object so that the thermal transfer layer 3 in the thermal transfer film 1 faces and comes into contact with the object, and the assembly is heated by means of a thermal head, a laser beam or the like from the backside of the substrate 2 to transfer the thermal transfer layer 31 and the thermal transfer layer 32 onto the object.

Figure 2:
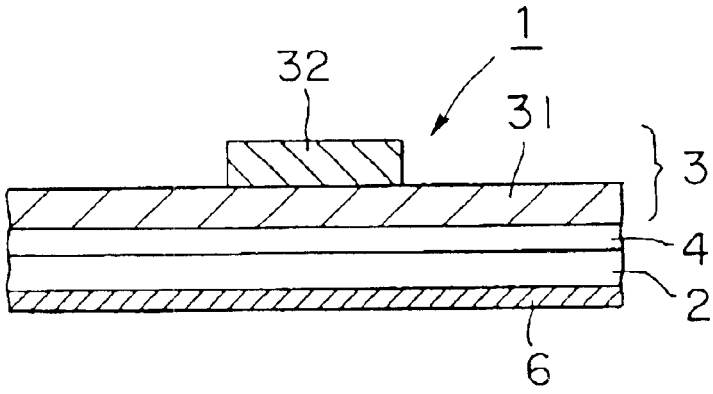
FIG. 2 is a cross-sectional view showing another embodiment of the thermal transfer film according to the present invention.

FIG. 2 is a cross-sectional view showing another embodiment of a thermal transfer film 1 according to the present invention. In the thermal transfer film 1, a release layer 4, a thermal transfer layer 31, and a thermal transfer layer 32 are stacked in that order on a substrate 2. The thermal transfer layer 32 is in a convex form and is located at a position most remote from the substrate 2. Further, a backside layer 6 is provided on the other side of the substrate 2. The thermal transfer film 1 shown in FIG. 2 is put on top of an object so that the thermal transfer layer 3 in the thermal transfer film 1 faces and comes into contact with the object, and the assembly is heated by means of a thermal head, a laser beam or the like from the backside layer 6 to transfer the thermal transfer layer 31 and the thermal transfer layer 32 onto the object while leaving the release layer 4 on the substrate 2 side.

Figure 3:
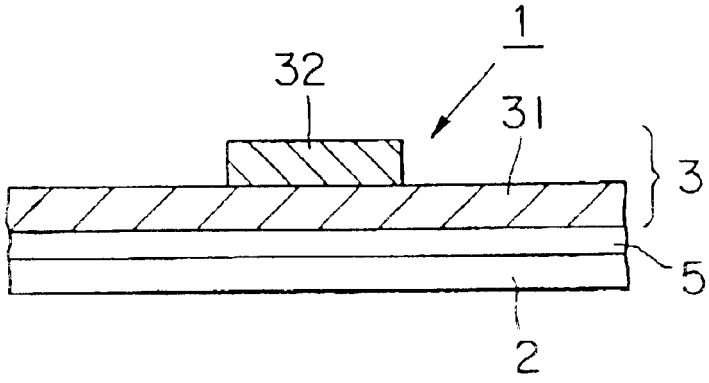
FIG. 3 is a cross-sectional view showing still another embodiment of the thermal transfer film according to the present invention.

FIG. 3 is a cross-sectional view showing still another embodiment of a thermal transfer film 1 according to the present invention. In the thermal transfer film 1, a peel layer 5, a thermal transfer layer 31, and a thermal transfer layer 32 are stacked in that order on a substrate 2. The thermal transfer layer 32 is in a convex form and is located at a position most remote from the substrate 2. The thermal transfer film 1 shown in FIG. 3 is put on top of an object so that the thermal transfer layer 3 in the thermal transfer film 1 faces and comes into contact with the object, and the assembly is heated by means of a thermal head, a laser beam or the like from the backside of the substrate 2 to transfer the peel layer 5, the thermal transfer layer 31, and the thermal transfer layer 32 onto the object.

Figure 4:
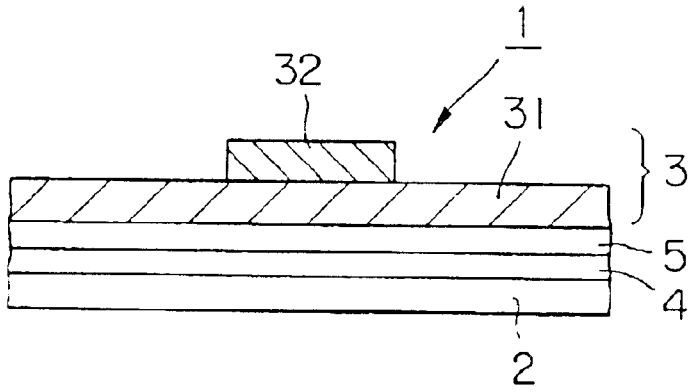
FIG. 4 is a cross-sectional view showing a further embodiment of the thermal transfer film according to the present invention.

FIG. 4 is a cross-sectional view showing a further embodiment of a thermal transfer film 1 according to the present invention. In the thermal transfer film 1, a release layer 4, a peel layer 5, a thermal transfer layer 31, and a thermal transfer layer 32 are stacked in that order on a substrate 2. The thermal transfer layer 32 is in a convex form and is located at a position most remote from the substrate 2. The thermal transfer film 1 shown in FIG. 4 is put on top of an object so that the thermal transfer layer 3 in the thermal transfer film 1 faces and comes into contact with the object, and the assembly is heated by means of a thermal head, a laser beam or the like from the backside of the substrate 2 to transfer the peel layer 5, the thermal transfer layer 31, and the thermal transfer layer 32 onto the object while leaving the release layer 4 on the substrate 2 side.

The layers and the like constituting the thermal transfer film according to the present invention will be described in detail.

Substrate

The same substrate as used in the conventional thermal transfer film as such may be used as the substrate 2 in the thermal transfer film according to the present invention. Further, substrates having a surface subjected to easy-adhesion treatment and the like may also be adopted without particular limitation. Specific examples of preferred substrates include: films of plastics including polyethylene terephthalate and, further, polyesters, polycarbonates, polyamides, polyimides, cellulose acetate, polyvinylidene chloride, polyvinyl chloride, polystyrene, fluororesin, polypropylene, polyethylene, and ionomers; papers such as glassine paper, capacitor paper, and paraffin-waxed paper; and cellophane. Further, a composite film produced by stacking two or more of them on top of each other or one another may also be used. The thickness of the substrate 2 may properly vary depending upon materials so that the substrate has proper strength and heat resistance. In general, however, the thickness of the substrate 2 is preferably about 2 to 100 $\mu$m.

Thermal Transfer Layer

In the thermal transfer film according to the present invention, the thermal transfer layer 3 is provided on the substrate at a position most remote from the substrate and has a convex. The thermal transfer layer 3 has a multilayer structure of at least two layers. The two layers are the thermal transfer layer 32 in a convex form and the thermal transfer layer 31 underlying the thermal transfer layer 32 in a convex form. A thermally transferred image 7 is formed onto the thermal transfer layer 3 by transfer from a thermal transfer recording medium 5 comprising a thermal transfer ink layer 6 provided on a substrate 22, and the thermal transfer layer 3 including the image 7 is transferred onto an object (an image formation object) 8. This thermal transfer layer 31 functions as a protective layer of the image 7 and contributes to fastness or resistance properties of the image, such as abrasion resistance, lightfastness, and alteration preventive property. Upon the transfer onto the object, the thermal transfer layer 32 as the convex is legible by the reflection of light according to the angle of the line of sight to the transferred face and thus can impart an alternation preventive property and a three-dimensional good appearance. The thermal transfer layer 32 forms a convex of a letter or an image pattern.

As described above, the thermal transfer layer has a multilayer structure of at least two layers of the thermal transfer layer 31 and the thermal transfer layer 32. All of these layers may be formed of an identical material. The thermal transfer layer may be formed of a proper resin having excellent abrasion resistance, transparency, hardness and other properties. Specific examples of resins usable herein include polyester resin, vinyl chloride-vinyl acetate copolymer, polystyrene resin, acrylic resin, polyurethane resin, acrylated urethane resin, polycarbonate resin, silicone-modified products of these resins, and mixtures of these resins. For example, a resin produced by crosslinking and curing an acrylic monomer or the like by ionizing radiation irradiation or the like may also be used. Specific examples of acrylic monomers include ethylene glycol di(meth) acrylate, hexanediol di(meth)acrylate, trimethylolpropane tri(meth)acrylate, trimethylolpropane di(meth)acrylate, pentaerythritol tetra(meth)acrylate, dipentaerythritol hexa (meth)acrylate, ethylene glycol diglycidyl ether di(meth) acrylate, propylene glycol diglycidyl ether di(meth)acrylate, and sorbitol tetraglycidyl ether tetra(meth)acrylate. The material to be cured by the ionizing radiation is not limited to the monomer and may be used as an oligomer. Further, polymers or derivatives of the above materials, for example, reactive acrylic polymers, such as polyester acrylate, epoxy acrylate, urethane acrylate, and polyether acrylate polymers, may be used. The above materials may also be used in combination with other acrylic resin(s).

These resins may contain, for example, highly transparent fine particles of silica, alumina, calcium carbonate, plastic pigment or the like or wax, from the viewpoint of the transferability of these resins in such an amount that is not detrimental to the transparency. Further, these resins may contain lubricants or the like from the viewpoint of improving abrasion resistance, gloss and the like of the image.

The thermal transfer layer is preferably composed mainly of a thermoplastic resin having a glass transition point of 50 to 120° C. In this case, after transfer onto the object, the thermal transfer layer functions as a protective layer which can impart excellent fastness or resistance properties such as excellent abrasion resistance and lightfastness.

The thermoplastic resin is preferably a polyester resin having a number average molecular weight of 2000 to 30000, a vinyl chloride-vinyl acetate copolymer having an average degree of polymerization of 150 to 500, or a homopolymer or copolymer, of a methacrylate monomer, having a weight average molecular weight of 20000 to 60000. This can improve transferability and fixation of the thermal transfer layer onto the object.

In the polyester resin, examples of aromatic acids usable as the acid component include terephthalic acid, isophthalic acid, o-phthalic acid, and 2,6-naphthalenedicarboxylic acid, and examples of aliphatic or alicyclic dicarboxylic acids usable as the acid component include succinic acid, adipic acid, azelaic acid, sebacic acid, dodecanedioic acid, dimmer acid, tetrahydrophthalic acid, hexahydrophthalic acid, hexahydroisophthalic acid, and hexahydroterephthalic acid. Tri- or higher functional polycarboxylic acids, such as trimellitic acid and pyromellitic acid, may also be used.

In the thermal transfer film according to the present invention, preferably, the thermal transfer layer is formed of a polyester resin particularly using terephthalic acid, isophthalic acid, and trimellitic acid as constituent monomers of the acid component. In this case, upon transfer onto the object, the thermal transfer layer functions as a protective layer which can impart excellent fastness or resistance properties such as excellent abrasion resistance and lightfastness.

Examples of the alcohol component as another component of the polyester resin include ethylene glycol, 1,2-propylene glycol, 1,3-propanediol, 1,4-butanediol, neopentyl glycol, 1,5-pentanediol, 1,6-hexanediol, 1,4-cyclohexanedimethanol, and tricyclodecane glycol. From the viewpoints of fastness or resistance properties, such as abrasion resistance and lightfastness, transferability, fixation and the like as the protective layer, a polyester resin particularly using at least two or more of ethylene glycol, neopentyl glycol, and tricyclodecane glycol as constituent monomers are preferred because the glass transition point and the number average molecular weight can be easily regulated to the range of 50 to 120° C. and the range of 2000 to 30000, respectively.

A vinyl chloride-vinyl acetate copolymer may be mentioned as a preferred thermoplastic resin used in the thermal transfer layer. The vinyl chloride vinyl acetate copolymer preferably has a glass transition point in the range of 50 to 120° C. and an average degree of polymerization in the range of 150 to 500. In producing this vinyl chloride-vinyl acetate copolymer, preferably, 5 to 40% by weight of a vinyl acetate monomer is formulated. When the amount of vinyl acetate formulated is above the upper limit of the above-defined amount range, blocking likely to occur. On the other hand, when the amount of vinyl acetate formulated is below the lower limit of the above-defined amount range, the solubility of the copolymer in a solvent at the time of coating of the copolymer onto the substrate is so low that the coatability is poor.

The thermoplastic resin constituting the thermal transfer layer is preferably a monopolymer or copolymer of a methacrylate monomer.

Methacrylate monomers usable herein include, for example, methyl methacrylate, ethyl methacrylate, n-propyl methacrylate, i-propyl methacrylate, n-butyl methacrylate, i-butyl methacrylate, sec-butyl methacrylate, cyclohexyl methacrylate, benzyl methacrylate, 2-ethylhexyl methacrylate, 2-hydroxyethyl methacrylate, and 2-hydroxypropyl methacrylate.

The thermal transfer layer may be formed by adding necessary additives to the above resin for the thermal transfer layer, dissolving the mixture in a suitable organic solvent or dispersing the mixture in an organic solvent or water, coating the solution or dispersion onto a substrate by forming means, such as gravure coating, gravure reverse coating, or roll coating, and drying the coating. The thermal transfer layer may be formed in any desired thickness. Preferably, the coverage of the thermal transfer layer is 0.1 to 50 g/m$^2$, more preferably 0.2 to 10 g/m$^2$, on a dry basis.

As described above, in the formation of the thermal transfer layer having a convex in a part thereof on the substrate, a convex may be formed by partially heating a separately provided thermal transfer film by means of a heat source such as a thermal head to thermally transfer a part of the thermal transfer layer from the thermal transfer film onto a thermal transfer layer in another thermal transfer film. The formation of the convex is not limited to that by the thermal transfer means. In the present invention, for example, the convex is formed by an ink jet recording method wherein a transparent ink jet recording ink is provided and is ejected through a nozzle onto a part of the thermal transfer layer in the thermal transfer film. Alternatively, an electro photographic method may be adopted which comprises the steps of: forming an electrostatic latent image on a photoreceptor by exposure; developing the latent image with a transparent toner; and then transferring the toner image onto the thermal transfer film to form a convex.

In the thermal transfer film according to the present invention, a thermal transfer layer is provided separably on the substrate. The thermal transfer layer may be provided on the substrate through a release layer. In this case, upon heating, the thermal transfer layer can be more easily separated from the substrate. At the time of the thermal transfer, the release layer is not separated from the substrate and is left on the substrate side.

Release Layer

In the thermal transfer film, some combination of the material for the substrate with the material for the thermal transfer layer sometimes results in unsatisfactory separation of the thermal transfer layer from the substrate at the time of the thermal transfer. In this case, a release layer 4 may be previously provided on the substrate. The release layer may be formed of one material or a mixture of two or more materials selected from waxes, silicon wax, and resins such as silicone resins, fluororesins, acrylic resins, polyvinyl alcohol, urethane resins, cellulosic resins such as cellulose acetate, polyvinyl acetal resins, and polyvinyl butyral resins. When two or more materials are mixed, a water-soluble resin may be used according to need. The release layer may be formed by coating a coating liquid composed mainly of these resins or the like by a conventional method, such as gravure coating or gravure reverse coating, and drying the coating. A coverage of the coating of about 0.01 to 2 g/m$^2$ suffices for the release layer. In selecting the material for the release layer, attention should be paid to proper separability of the release layer from the thermal transfer layer, as well as to the satisfaction of a requirement that the adhesion between the release layer and the substrate is larger than the adhesion between the release layer and the thermal transfer layer. Unsatisfactory adhesion between the release layer and the substrate is causative of abnormal transfer such as transfer of the release layer together with the thermal transfer layer. When a matte appearance is desired in the print after the transfer of the transfer layer, the surface of the print after the transfer of the thermal transfer layer can be rendered matte by incorporating various particles into the release layer or by using a substrate of which the surface on the release layer side has been rendered matte.

In the thermal transfer film according to the present invention, the thermal transfer layer is provided separably on the substrate. The thermal transfer layer may be provided on the substrate through a peel layer. In this case, upon heating, the thermal transfer layer can be more easily separated from the substrate. This peel layer can be separated from the substrate at the time of thermal transfer.

Peel Layer

The peel layer 5 may be formed by coating a coating liquid containing, for example, waxes, silicone wax, silicone resins, fluororesins, acrylic resins, polyvinyl alcohol resins, cellulose derivative resins, polyvinyl acetal resins, polyvinyl butyral resins, vinyl chloride-vinyl acetate copolymer, or chlorinated polyolefin or a copolymer of a group of these resins or the like by conventional forming means such as gravure printing, screen printing, or reverse roll coating using a gravure plate, and drying the coating.

The coverage of the peel layer is about 0.01 to 5 g/m$^2$ on a dry basis.

Further, in the thermal transfer film, an adhesive layer may be provided on the thermal transfer layer provided on the substrate to improve the fixation of the transfer layer onto an object at the time of the thermal transfer. The adhesive layer is preferably formed of a material which, upon heating, can develop an adhesive property. For example, the adhesive layer may be formed using thermoplastic synthetic resin, naturally occurring resin, rubber, wax or the like by the same forming means as used in the formation of the peel layer. The coverage of the adhesive layer is about 0.01 to 5 g/m$^2$.

Backside Layer

In the thermal transfer film, a backside layer 6 may be provided on the substrate in its side remote from the thermal transfer layer from the viewpoints of preventing blocking between the thermal transfer film and a thermal head or the like and, at the same time, improving slipperiness.

The backside layer 6 may be formed of a single resin or a mixture of two or more resins selected from naturally occurring or synthetic resins, for example, cellulosic resins, such as ethylcellulose, hydroxycellulose, hydroxypropylcellulose, methylcellulose, cellulose acetate, cellulose acetate butyrate and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resin, polyvinyltoluene resin, coumarone-indene resin, polyester resin, polyurethane resin, and silicone-modified or fluorine-modified urethane. In order to further enhance the heat resistance of the backside layer, preferably, among the above resins, a resin containing a reactive group based on a hydroxyl group is used in combination with polyisocyanate or the like as a crosslinking agent to form a crosslinked resin layer as the backside layer.

In order to impart slidability against the thermal head, a solid or liquid release agent or lubricant may be added to the backside layer to impart heat-resistant slipperiness to the backside layer. Release agents or lubricants include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesin, silicone resin, and fine particles of inorganic compounds such as talc, and silica. The content of the lubricant in the backside layer is about 5 to 50% by weight, preferably about 10 to 30% by weight.

The backside layer may be formed by dissolving or dispersing the above resin, optionally together with a release agent, a lubricant and the like, in a suitable solvent to prepare a coating liquid, coating the coating liquid by a conventional coating method such as gravure coating, roll coating, or wire bar coating, and drying the coating. The coverage of the backside layer is about 0.1 to 10 g/m$^2$ on a dry basis.

Figure 5:
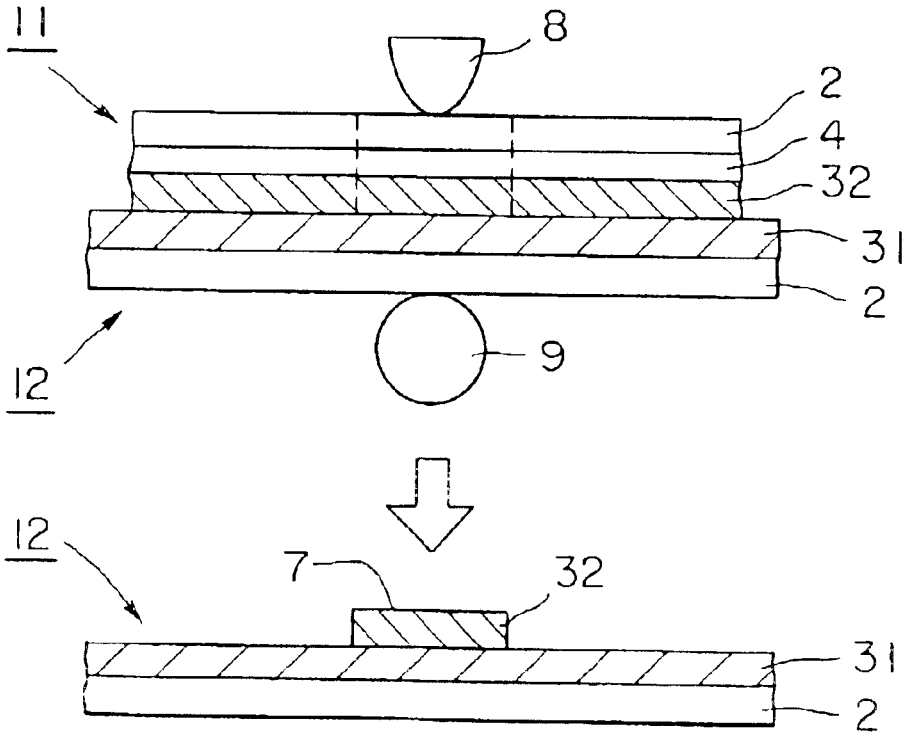
FIG. 5 is a schematic view illustrating one embodiment of the production process of the thermal transfer film according to the present invention.
Figure 6:
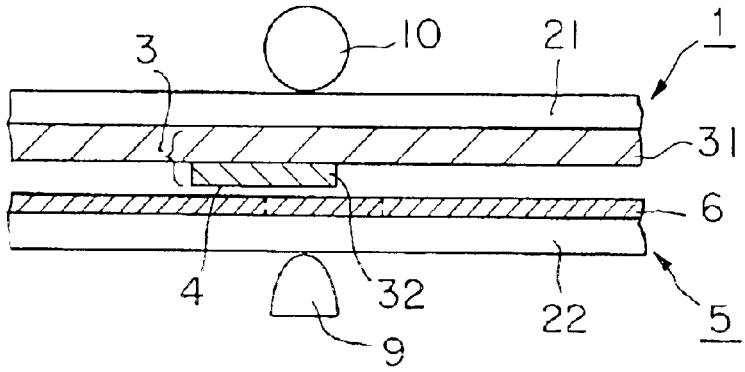
FIG. 6 is a schematic view illustrating the method for image formation according to the present invention.
Figure 7:
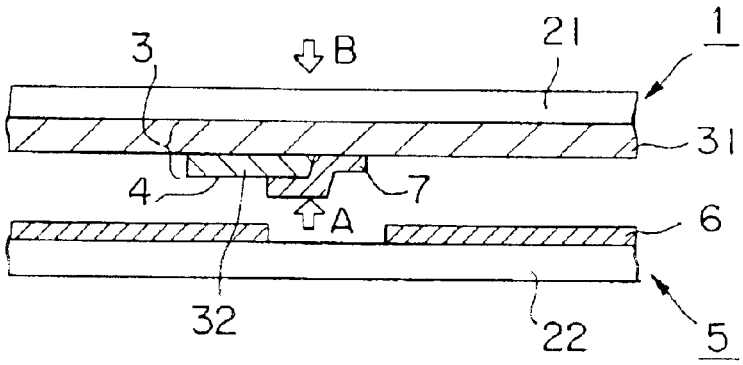
FIG. 7 is a schematic view illustrating the method for image formation according to the present invention.
Figure 8:
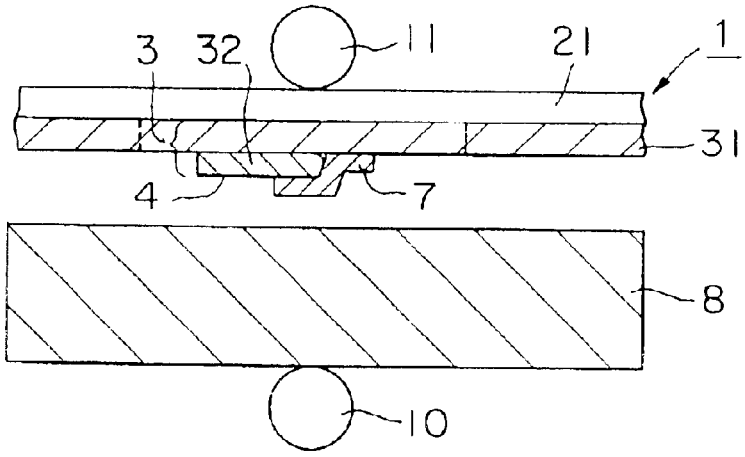
FIG. 8 is a schematic view illustrating the method for image formation according to the present invention.

Next, the production process of the above thermal transfer film will be described. FIG. 5 is a schematic view illustrating one embodiment of the production process of the thermal transfer film according to the present invention. A thermal transfer film 11 comprising a release layer 4 and a thermal transfer layer 32 provided in that order on one side of a substrate 2, that is, a thermal transfer film 11 wherein a thermal transfer layer 32 is provided at a position most remote from a substrate 2, is put on top of a thermal transfer film 12 comprising a thermal transfer layer 31 provided on one side of a substrate 2, that is, a thermal transfer film 12 wherein a thermal transfer layer 31 is provided at a position most remote from a substrate 2, so that the thermal transfer layer 32 in the thermal transfer film 11 faces the thermal transfer layer 31 in the thermal transfer film 12. The assembly is partially heated by means of a thermal head 8 from the backside of the thermal transfer film 11. Alternatively, in such a state that the thermal transfer film 11 and the thermal transfer film 12 have been put on top of each other, the two thermal transfer films may be pressed between the thermal head 8 and a platen roll 9. Thus, a part of the thermal transfer layer 32 in the thermal transfer film 11 is transferred onto the thermal transfer layer 31 in the thermal transfer film 12, whereby a thermal transfer film 12 provided with a thermal transfer layer 32 having a convex 7 in a part thereof is provided. In this thermal transfer film 12, a thermal transfer layer 32 having a convex 7 in a part thereof is provided on one side of the substrate 2 at a position most remote from the substrate 2.

As described above, in the formation of the thermal transfer layer having a convex in a part thereof on the substrate, the convex may be formed by partially heating a separately provided thermal transfer film by means of a heat source such as a thermal head to thermally transfer a part of the thermal transfer layer from the thermal transfer film onto a thermal transfer layer in another thermal transfer film. The formation of the convex is not limited to that by the thermal transfer means. In the present invention, for example, the convex may be formed by an ink jet recording method wherein an ink jet recording ink is provided and is ejected through a nozzle onto a part of the thermal transfer layer in the thermal transfer film. Alternatively, an electro photographic method may be adopted which comprises the steps of: forming an electrostatic latent image on a photoreceptor by exposure; developing the latent image with a transparent toner; and then transferring the toner image onto the thermal transfer film to form a convex.

In the thermal transfer layer formed by the above method, when the height (thickness) of the convex portion in the thermal transfer layer formed in this way is in the range of 0.2 to 5.0 $\mu$m, the convex portion in the thermal transfer layer transferred onto the object is easily legible by the reflection of light according to the angle of the line of sight to the transfer face. Therefore, the thickness (height) of the convex portion is preferably in the range of 0.2 to 5.0 $\mu$m. For example, when the convex portion is formed by thermal transfer, a method is preferably adopted wherein a thermal transfer layer for forming the convex portion is previously provided in the form of a thermal transfer film having the above thickness and the thermal transfer layer is thermally transferred at a time in the thickness wise direction, that is, without leaving the thermal transfer layer on the substrate side.

Next, a preferred embodiment of the method for image formation using the thermal transfer film according to the present invention will be described in detail with reference to the accompanying drawings.

There are two methods for the transfer of the thermal transfer layer onto an object to form an image on the object using the thermal transfer film according to the present invention.

One of the methods comprises the steps of: providing an object on which the above thermal transfer layer is to be transferred and an image has been previously formed by a thermal transfer recording method or the like; and transferring the above thermal transfer layer onto the image (direct transfer method). The transferred layer can protect the image and permits the convex portion in the thermal transfer layer transferred onto the object to be legible by the reflection of light according to the angle of the line of sight to the image recorded face.

On the other hand, in the other method, an image is not formed directly on the object. Specifically, the other method comprises the steps of: providing the thermal transfer film according to the present invention and a thermal transfer recording medium comprising a substrate and, provided on at least one side of the substrate, a thermal transfer ink layer containing a thermoplastic resin and a colorant; putting the thermal transfer film on top of the thermal transfer recording medium so that the thermal transfer layer faces the thermal transfer ink layer; imagewise heating the stacked thermal transfer recording medium to imagewise transfer the thermal transfer ink layer or the colorant onto the thermal transfer layer in the thermal transfer film, whereby a reverse image is once formed on the thermal transfer film; then putting the thermal transfer film with an image formed thereon and an object on top of each other so that the thermal transfer layer in the thermal transfer film faces the image forming face of the object; heating the stacked thermal transfer film from its side remote from the thermal transfer layer to transfer the thermal transfer layer with an image formed thereon onto the object, whereby an image is formed on the object (retransfer method). In this case, in the image-formed object, the image is protected by the thermal transfer layer, and the convex in the thermal transfer layer transferred onto the object is legible by the reflection of light according to the angle of the line of sight to the image recorded face.

FIGS. 6 to 9 are schematic views illustrating the method for image formation according to the present invention. A thermal transfer film 1 comprising a substrate 21, a thermal transfer layer 31 provided on one side of the substrate 21, and a thermal transfer layer 32 provided on a part of the thermal transfer layer 31, that is, a thermal transfer film 1 wherein a thermal transfer layer 3 having a convex portion 4 in a part thereof is provided on one side of a substrate 21 at a position most remote from the substrate 21, and a thermal transfer recording medium 5 comprising a substrate 22 and, provided on at least one side of the substrate 22, a thermal transfer ink layer 6 containing a thermoplastic resin and a colorant are provided. The thermal transfer film 1 and the thermal transfer recording medium 5 are put on top of each other so that the thermal transfer layer 3 in the thermal transfer film 1 faces the thermal transfer ink layer 6 in the thermal transfer recording medium 5. The assembly is heated imagewise. In this case, the heating is carried out by means of a thermal head 9. Specifically, the thermal transfer film 1 and the thermal transfer recording medium 5 are sandwiched between the thermal head 9 and a platen roll 10, and, in this embodiment, the assembly is imagewise heated by means of the thermal head 9 from the thermal transfer recording medium 5 remote from the thermal transfer ink layer 6 (see FIG. 6).

After the heating, the stacked thermal transfer film 1 and thermal transfer recording medium 5 are separated from each other to transfer, as an image 7, the thermal transfer ink layer 6 or the colorant contained in the thermal transfer ink layer 6 in the thermal transfer recording medium 5 onto the thermal transfer layer 3 in the thermal transfer film 1. This image 7 is a reverse image (a mirror image) as viewed in a direction indicated by A and is a non-reverse image as viewed from a direction indicated by B (see FIG. 7).

Next, the thermal transfer film 1 with the image 7 formed thereon is put on top of an object 8 so that the thermal transfer layer 3 in the thermal transfer film 1 faces the image forming face of the object 8. The assembly is heated by means of a heat roll 11 from the thermal transfer film 1 in its side remote from the thermal transfer layer 3. In the heating by means of the heat roll 11, the thermal transfer film 1 and the object 8 are sandwiched, heated and pressed between the heat roll 11 and the platen roll 10 (see FIG. 8).

Figure 9:
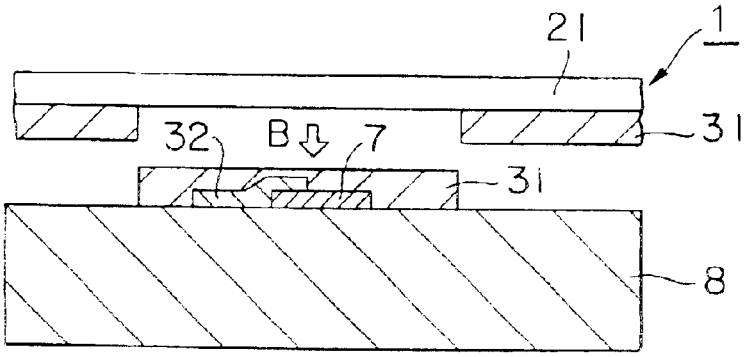
FIG. 9 is a schematic view illustrating the method for image formation according to the present invention.

After the heating, the stacked thermal transfer film 1 and object 8 are separated from each other, whereby the thermal transfer layers 31, 32 in their portion, heated by the thermal head 9 including the image 7 and the convex 4 in the thermal transfer film 1 are transferred onto the object 8 (see FIG. 9).

The thermal transfer layer in the thermal transfer film used in the present invention is preferably transparent or translucent so that the image formed of the thermal transfer ink layer derived from the thermal transfer recording medium can be seen through the image of the thermal transfer ink layer after transfer onto the object. "Translucent" refers to a state intermediate between a transparent state and an opaque state. That is, in the case of a transparent thermal transfer layer, when the image formed object is observed, the difference in refractive index of light between the transferred image portion formed of the thermal transfer ink layer derived from the thermal transfer recording medium and the thermal transfer layer portion transferred onto the object is so small that the transferred image portion can be easily seen through the thermal transfer layer. On the other hand, when the thermal transfer layer is opaque, the difference in refractive index of light between the transferred image portion formed of the thermal transfer ink layer and the thermal transfer layer portion transferred onto the object is so large that the transferred image portion cannot be seen through the thermal transfer layer, that is, light cannot pass through the thermal transfer layer.

Further, the light transmission property of the convex in the thermal transfer layer in the thermal transfer film is preferably different from the light transmission property of the thermal transfer layer in its portion other than the convex portion. When the thermal transfer layer in this thermal transfer film is transferred onto an object, the convex in the thermal transfer layer transferred onto the object is easily legible by the reflection of light according to the angle of the line of sight to the image recorded face of the image formed object. To this end, a method may be adopted wherein the light transmission property of the thermal transfer layer 31, which widely covers the object to function as a protective layer, is made somewhat better than the light transmission property of the thermal transfer layer 32 as the convex portion, or vice versa.

In the present invention, having a different light transmission property means that there is a difference in haze, light transmittance, or opaqueness.

Methods usable for regulating the transparency or light transmission property of the thermal transfer layer include one wherein a conventional colorant is incorporated into the thermal transfer layer, one wherein particles are incorporated into the thermal transfer layer, and one wherein the structure of the thermal transfer layer is brought to a porous network structure.

Among organic or inorganic pigments or dyes, cyan, magenta, yellow, black or other hues may be properly selected as the colorant. Pigments having a metallic luster, such as gold color, silver color, or copper color, fluorescent inorganic or organic pigments or dyes, and pigments or dyes of white or intermediate colors such as green, orange, and purple, may also be used. In this case, the amount of the colorant added should be regulated so that the colorant does not conceal the transferred image formed of the thermal transfer ink layer and the transferred image can be seen through the transfer layer. In order to enhance the light transmission property, the colorant is preferably in the state of dissolution in the coating liquid for the thermal transfer layer. From this point of view, the use of the dye as the colorant is preferred.

Particles usable for regulating the transparency or light transmission property of the thermal transfer layer include inorganic particles, such as particles of silica, titanium oxide, and calcium carbonate, and organic particles such as synthetic resin fillers.

The porous network structure of the thermal transfer layer can be formed by a conventional method. For example, a transparent resin varnish, as a coating liquid for the thermal transfer layer, comprising a resin, a good solvent having a relatively low boiling point, and a poor solvent having a relatively high boiling point is coated onto a substrate. This resin varnish is generally coated by a conventional coating method, such as gravure coating or silk screen coating, to a thickness of 0.5 to 10 $\mu$m. Next, resin varnish coating is dried. In this step of drying, the good solvent having a relatively low boiling point preferentially evaporates. As the evaporation of the good solvent proceeds, the resin phase in the resin varnish is separated from the remaining poor solvent phase. In this case, the resin gels, while the poor solvent takes the form of particles dispersed in the resin. As drying further proceeds, the evaporation of the high-boiling poor solvent in a particle form proceeds. Upon the completion of the evaporation of the poor solvent, the thermal transfer layer having a porous structure is formed. The pore diameter of the porous structure can be regulated by regulating the temperature, air flow and the like at the time of drying. In this connection, the following point should be noted. In the case of the thermal transfer layer having a porous structure, the pore diameter of the porous structure is regulated by taking into consideration the transparency and light transmission properties of the thermal transfer layer after transfer onto the object, rather than the transparency and light transmission properties of the thermal transfer layer in the thermal transfer film as formed by a production process which will be described later. This is because, in the thermal transfer layer having a porous structure, in some cases, heating at the time of thermal transfer somewhat causes a change in porous structure and consequently enhances the transparency and light transmission properties.

Next, the thermal transfer recording medium 5, wherein the thermal transfer ink layer 6 containing a thermoplastic resin and a colorant has been formed on at least one side of the substrate 22, used in the present invention will be described.

Substrate

Any substrate, which has hitherto been used as a substrate for thermal transfer recording media, may be used as the substrate 22 used in the thermal transfer recording medium so far as it can support the thermal transfer ink layer and has strength and heat resistance. Specifically, the substrate 22 may be formed of materials as described above in connection with the substrate for the thermal transfer film.

The thickness of the substrate may be properly selected depending upon materials so that the strength, heat resistance and the like are proper. In general, however, the thickness is preferably about 1 to 50 $\mu$m.

Thermal Transfer Ink Layer

The thermal transfer ink layer 6 provided on the substrate may be formed using a coating liquid containing a thermoplastic resin and a colorant and optionally additives, for example, lubricants such as waxes, dispersants, and anti-settling agents.

Various conventional colorants may be used as the colorant. Among organic or inorganic pigments or dyes, those having good properties as a recording material, for example, those, which have satisfactory color density and are less likely to cause color change and fading upon exposure, for example, to light, heat, and temperature, are preferred as the colorant. Colorants having cyan, magenta, yellow, black and other hues may be properly selected. Pigments having a metallic luster, such as gold color, silver color, or copper color, fluorescent inorganic or organic pigments or dyes, and pigments or dyes of white or intermediate colors such as green, orange, and purple, may also be used.

Among metallic pigments such as gold, silver, copper, zinc, aluminum, chromium and other metal or alloy powders, an aluminum pigment is preferably used because excellent metallic luster and opacifying effect can be realized independently of, for example, the color of the ground of the transfer face of the object. The aluminum pigment may be in a spherical form or a form similar to spheres. However, a platy aluminum pigment is preferred because excellent metallic luster and opacifying effect can be provided. Aluminum used in the thermal transfer layer preferably has an average length of about 1 to 20 $\mu$m and an average thickness of about 0.01 to 5 $\mu$m because the dispersibility in the coating liquid and the metallic luster of the formed image are excellent.

The thermal transfer recording medium according to the present invention comprises a substrate and a thermal transfer ink layer provided on one side of the substrate. Thermal transfer ink layers usable herein are roughly classified into two types, heat-fusion ink layers or sublimable dye ink layers. The heat-fusion ink layer comprises conventional colorant and binder and optionally various additives, for example, mineral oils, vegetable oils, higher fatty acids such as stearic acid, plasticizers, and fillers. Examples of the resin component used as the binder include ethylene-vinyl acetate copolymer, ethylene-acrylic ester copolymer, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, fluororesin, polyvinylformal, polyvinyl butyral, acetylcellulose, nitrocellulose, polyvinyl acetate, polyisobutylene, ethylcellulose, polyacetal, and polyester.

Examples of the wax component used as the binder include various waxes, for example, microcrystalline wax, carnauba wax, and paraffin wax. Further, other various waxes such as Fischer-Tropsh wax, various types of low-molecular weight polyethylene, Japan wax, beeswax, spermaceti, insect wax, wool wax, shellac wax, candelilla wax, petrolactum, polyester wax, partially modified wax, fatty esters, and fatty amides.

Preferably, the thermoplastic resin as the binder contained in the heat-fusion ink layer has a structure similar to the binder resin in the thermal transfer layer onto which the ink layer is to be transferred. In this case, high compatibility can be provided. This can realize excellent transferability and fixation onto the thermal transfer layer.

The colorant may be properly selected from the above-described conventional organic or inorganic pigments or dyes. Further, a heat-conductive material may be incorporated as a filler for the binder from the viewpoint of imparting good heat conductivity and heat-fusion transferability to the heat-fusion ink layer. Such fillers include, for example, carbonaceous materials, such as carbon black, and metals and metal compounds such as aluminum, copper, tin oxide, and molybdenum disulfide.

The heat-fusion ink layer may be formed by providing a coating liquid for a heat-fusion ink layer, prepared by mixing the colorant component, binder component, and optionally a solvent component, such as water or an organic solvent, and coating the coating liquid by a conventional method such as hot-melt coating, hot lacquer coating, gravure coating, gravure reverse coating, or roll coating. A formation method using an aqueous or nonaqueous emulsion coating liquid may also be used. The coverage of the heat-fusion ink layer should be determined so as to obtain a balance between necessary print density and heat sensitivity and is preferably in the range of about 0.1 to 30 g/m$^2$, more preferably about 1 to 20 g/m$^2$.

The sublimable dye ink layer as the thermal transfer ink layer is a layer comprising a sublimable dye supported by a binder resin. Dyes commonly used in conventional thermal transfer recording media may be effectively used without particular limitation. The following dyes may be mentioned as several examples of preferred dyes. Specifically, MS Red G, Macrolex Red Vioret R, Ceres Red 7B, Samaron Red HBSL, and Resolin Red F 3BS may be mentioned as red dyes. Phorone Brilliant Yellow 6 GL, PTY-52, Macrolex Yellow 6G and the like may be mentioned as yellow dyes. Kayaset Blue 714, Waxoline Blue AP-FW, Phorone Brilliant Blue S-R, and MS Blue 100 may be mentioned as blue dyes.

Any conventional binder resin (thermoplastic resin) may be used for carrying the above sublimable dyes, and examples of preferred binder resins include: cellulosic resins such as ethylcellulose, hydroxyethylcellulose, ethylhydroxy-cellulose, hydroxypropylcellulose, methylcellulose, cellulose acetate, and cellulose acetate butyrate; vinyl resins such as polyvinyl alcohol, polyvinyl acetate, polyvinyl butyral, polyvinyl acetal, polyvinyl pyrrolidone, and polyacrylamide; and polyesters.

Further, in order to enhance the separability of the thermal transfer ink layer from the thermal transfer layer as the image receiving side at the time of the formation of a thermally transferred image, a graft copolymer having at least one releasable segment selected from a polysiloxane segment, a carbon fluoride segment, and a long-chain alkyl segment each graft bonded to the main chain of an acrylic, vinyl, polyester, polyurethane, polyamide, or cellulosic resin may be used as the binder resin for carrying the thermally transferable dye.

The use of a dyeable thermoplastic resin binder is required in the thermal transfer layer for receiving the dye in the sublimable dye ink layer. Further, if necessary, a release agent, such as a fluorosurfactant, a silicone oil and/or a cured product thereof, may be incorporated into the sublimable dye ink layer so that, upon heating at the time of the formation of an image, the sublimable dye ink layer and the thermal transfer layer can be smoothly separated from each other without heat fusing. Fluorosurfactants include Fluorad FC-430 and FC-431, manufactured by 3M. Silicone oils include various modified silicone oils and cured products thereof, as described in "Sirikohn Handobukku (Silicone Handbook)" published by The Nikkan Kogyo Shimbun, Ltd. When the formation of a dye image formed of the sublimable dye ink layer on the thermal transfer layer is followed by the transfer and adhesion of the image-formed thermal transfer layer onto an object, the use of a fluorosurfactant and an uncured silicone oil is particularly preferred because they have high adhesion. It is a matter of course that the use of the graft copolymer having a releasable segment as the binder resin in the thermal transfer layer can eliminate the need to add any release agent and can realize high adhesion between the object and the image-formed thermal transfer layer and thus is preferred.

The sublimable dye ink layer may contain, in addition to the dye and the binder resin, optional various conventional additives. The sublimable dye ink layer may be formed by dissolving or dispersing the dye, the binder resin, and additives in a suitable solvent to prepare an ink and coating the ink onto the substrate by the same coating method as described above in connection with the heat-fusion ink layer. The coverage of the sublimable dye ink layer is about 0.1 to 5.0 g/m$^2$, preferably about 0.4 to 2.0 g/m$^2$.

Backside Layer

In the thermal transfer recording medium, a backside layer may be provided on the substrate in its side remote from the thermal transfer ink layer from the viewpoints of preventing blocking between the thermal transfer recording medium and a thermal head and, at the same time, improving slipperiness. This backside layer may be formed of the same material as used in the formation of the backside layer which may be provided in the thermal transfer film.

In the thermal transfer recording medium provided with a heat-fusion ink layer as the thermal transfer ink layer used in the present invention, the thermal transfer ink layer may be provided through a peel layer to further facilitate the separation of the thermal transfer ink layer from the substrate upon heating. Further, an adhesive layer, an intermediate layer or the like may be provided on the thermal transfer ink layer in the thermal transfer recording medium. On the other hand, in the case of the thermal transfer recording medium provided with a sublimable dye ink layer as the thermal transfer ink layer, the thermal transfer ink layer is provided on the substrate. In this case, an intermediate layer, such as a primer layer, may be provided between the substrate and the thermal transfer ink layer to enhance the adhesion between the substrate and the thermal transfer ink layer.

The same material and formation method as used in the peel layer and the adhesive layer in the thermal transfer film may be applied to the peel layer and the adhesive layer in the thermal transfer recording medium.

Method for Image Formation

In the method for image formation according to the present invention, means for imagewise heating used in forming an image on the thermal transfer layer in the thermal transfer film by the thermal transfer of the thermal transfer ink layer in the thermal transfer recording medium may be conventional thermal energy impartation means for thermal transfer, such as heating by means of a thermal head or laser beam irradiation.

Examples of means for transferring the thermal transfer layer, with an image formed thereon using the thermal transfer ink layer, onto an object include a thermal head usable in the formation of a transferred image, a line heater, a heat roll, and a hot stamp.

In the present invention, in order that the finally obtained image in the image formed object is oriented in a proper direction, an image having a mirror relationship with the final image should be formed in the thermal transfer layer on the thermal transfer film.

The object, on which an image is formed by the retransfer of the image-formed thermal transfer layer in the thermal transfer film, is not particularly limited. Examples thereof include sheets or three-dimensional molded products of plain paper, wood free paper, tracing paper, various plastics or the like. The object may be in the form of any of cards, postal cards, passports, letter papers or writing pads, report pads, notebooks, catalogs, cups, cases, building materials, panels, electronic components, such as telephones, radios, and televisions, and rechargeable batteries. According to the method for image formation according to the present invention, recording can be carried out even on objects formed of a sparingly adhesive plastic material, such as polycarbonate resin, polypropylene resin, polyethylene resin, polyethylene terephthalate resin, or polymethyl methacrylate, with good transferability and adhesion.

EXAMPLES

The following examples and comparative examples further illustrate the present invention. In the following description, "parts" or "%" is by weight.

Preparation of Thermal Transfer Films 1 to 31

Thermal transfer films 1 to 31 were prepared under conditions specified for each layer in Table 5. Specifically, a backside layer having a composition specified in Table 4 was coated at a coverage of 0.2 g/m$^2$ on a solid basis onto a substrate specified in Table 5. A release layer, a peel layer, and a thermal transfer layer were formed in that order on the other side of the substrate under conditions specified in Table 5. The composition of the release layer is shown in Table 5, and details of resins used are shown in Table 2.

The composition of the peel layer is shown in Table 5, and details of resins used are shown in Table 3.

The composition of the thermal transfer layer is shown in Table 5, and details of resins used are shown in Table 1.

TABLE 1

Polyester resins for thermal transfer layer

| | Tg, ° C. | Number average molecular weight | Carboxylic acid component | Alcohol component |
|---|---|---|---|---|
| Resin A1 | 65 | 20000 | Terephthalic acid/isophthalic acid | Ethylene glycol/neopentyl glycol |
| Resin A2 | 52 | 4000 | Terephthalic acid/isophthalic acid | Ethylene glycol/neopentyl glycol |
| Resin A3 | 75 | 15000 | Terephthalic acid/isophthalic acid | Ethylene glycol/neopentyl glycol/tricyclodecane glycol |
| Resin A4 | 80 | 8000 | Terephthalic acid/isophthalic acid | Ethylene glycol/tricyclodecane glycol |
| Resin A5 | 95 | 5000 | Terephthalic acid/isophthalic acid/trimellitic acid | Ethylene glycol/tricyclodecane glycol |
| Resin A6 | 20 | 10000 | Terephthalic acid/isophthalic acid/sebacic acid | Ethylene glycol/neopentyl glycol |

Methacrylate copolymer/homopolymer for thermal transfer layer

| | Tg, ° C. | Weight average molecular weight | Methacrylate component |
|---|---|---|---|
| Resin B1 | 105 | 40000 | Methyl methacrylate |
| Resin B2 | 105 | 25000 | Methyl methacrylate |
| Resin B3 | 75 | 30000 | Methyl methacrylate/n-butyl methacrylate |
| Resin B4 | 50 | 50000 | Methyl methacrylate/n-butyl methacrylate |
| Resin B5 | 85 | 35000 | Methyl methacrylate/iso-butyl methacrylate |
| Resin B6 | 105 | 95000 | Methyl methacrylate |

TABLE 1-continued

| Vinyl chloride/vinyl acetate copolymer for thermal transfer layer | | | |
|---|---|---|---|
| | Tg, ° C. | Average degree of polymerization | Constituents (trade name) |
| Resin C1 | 65 | 430 | Vinyl chloride/vinyl acetate |
| Resin C2 | 65 | 320 | Vinyl chloride/vinyl acetate |
| Resin C3 | 52 | 200 | Vinyl chloride/vinyl acetate |
| Resin C4 | 70 | 300 | Vinyl chloride/vinyl acetate/vinyl alcohol |
| Resin C5 | — | — | Vinyl chloride/vinyl acetate/maleic acid (TF-120, manufactured by Denki Kagaku Kogyo K. K.) |
| Resin C6 | — | — | Vinyl chloride/vinyl acetate/vinyl alcohol (#1000 GSK, manufactured by Denki Kagaku Kogyo K. K.) |

TABLE 2

| Water-soluble polyvinyl acetal for release layer | | |
|---|---|---|
| | Degree of acetalization, mol % | Trade name |
| Resin D1 | 5–11 | KX-1 (Sekisui Chemical Co., Ltd.) |
| Resin D2 | 6–12 | KW-1 (Sekisui Chemical Co., Ltd.) |
| **Polyvinyl alcohol for release layer** | | |
| | Degree of saponification, mol % | Trade name |
| Resin E1 | 99.0–100 | NM-11 (Nippon Synthetic Chemical Industry Co., Ltd.) |
| Resin E2 | 98.5–99.4 | NH-20 (Nippon Synthetic Chemical Industry Co., Ltd.) |
| Resin E3 | 97.0–98.5 | AH-17 (Nippon Synthetic Chemical Industry Co., Ltd.) |
| Resin E4 | 86.5–89.0 | GH-14 (Nippon Synthetic Chemical Industry Co., Ltd.) |
| Resin E5 | 76.7–79.3 | KM-11 (Nippon Synthetic Chemical Industry Co., Ltd.) |

TABLE 3

| Methacrylate copolymer/homopolymer for peel layer | | | |
|---|---|---|---|
| | Tg, ° C. | Weight average molecular weight | Methacrylate component |
| Resin F1 | 105 | 40000 | Methyl methacrylate |
| Resin F2 | 105 | 25000 | Methyl methacrylate |
| Resin F3 | 75 | 30000 | Methyl methacrylate/n-butyl methacrylate |
| Resin F4 | 50 | 50000 | Methyl methacrylate/n-butyl methacrylate |
| Resin F5 | 85 | 35000 | Methyl methacrylate/iso-butyl methacrylate |
| Resin F6 | 105 | 95000 | Methyl methacrylate |

TABLE 4

| Composition of backside layer | Parts by weight |
|---|---|
| Styrene-acrylonitrile copolymer | 45 |
| Linear saturated polyester | 2 |
| Zinc stearyl phosphate | 21 |
| Powder of crosslinked urea resin | 21 |
| Powder of crosslinked melamine resin | 11 |

TABLE 5

| Thermal transfer film | | | | | | | | |
|---|---|---|---|---|---|---|---|---|
| | Coverage of | | Release layer | | Peel layer | | Thermal transfer layer | |
| | backside layer, g/m$^2$ | Substrate | Composition | Coverage, g/m$^2$ | Composition | Coverage, g/m$^2$ | Composition | Coverage, g/m$^2$ |
| Thermal transfer film 1 | 0.2 | PET film with one side being corona treated (12 μm) | D1 | 0.2 | — | — | A5 alone | 4.0 |
| Thermal transfer film 2 | 0.2 | PET film with one side being corona treated 12 (μm) | D1 | 0.2 | — | — | A1/A5 = 50/50 | 7.0 |
| Thermal transfer film 3 | 0.2 | PET film with one side being corona treated 12 (μm) | D1 | 0.2 | — | — | A1/A5/carnauba wax = 48/48/4 | 6.0 |
| Thermal transfer film 4 | 0.2 | PET film with one side being corona treated 12 (μm) | D1 | 0.2 | — | — | A1/A5/silica = 49/49/2 | 6.0 |
| Thermal transfer film 5 | 0.2 | PET film with one side being corona treated 12 (μm) | D2 | 0.5 | — | — | A3/A5 = 50/50 | 6.0 |
| Thermal transfer film 6 | 0.2 | PET film with one side being corona treated 12 (μm) | D2 | 0.5 | F1/carnauba wax = 98/2 | 1.0 | A1/carnauba wax = 97/3 | 4.0 |

TABLE 5-continued

| | Coverage of backside layer, g/m$^2$ | Substrate | Thermal transfer film: Release layer Composition | Release layer Coverage, g/m$^2$ | Peel layer Composition | Peel layer Coverage, g/m$^2$ | Thermal transfer layer Composition | Thermal transfer layer Coverage, g/m$^2$ |
|---|---|---|---|---|---|---|---|---|
| Thermal transfer film 7 | 0.2 | PET film with one side being corona treated 12 (μm) | — | — | F3/polyethylene wax = 98/2 | 2.0 | A2/A3 = 40/60 | 5.0 |
| Thermal transfer film 8 | 0.2 | PET film with one side being corona treated 12 (μm) | D2 | 0.1 | F5/polyethylene wax = 98/2 | 1.0 | A4/carnauba wax = 98/2 | 5.0 |
| Thermal transfer film 9 | 0.2 | PET film with one side being corona treated 12 (μm) | E1 | 0.2 | — | — | A1/A5 = 60/40 | 5.0 |
| Thermal transfer film 10 | 0.2 | PET film with one side being corona treated 12 (μm) | E2 | 0.2 | — | — | A1/A5 = 60/40 | 5.0 |
| Thermal transfer film 11 | 0.2 | PET film with one side being corona treated 12 (μm) | E3 | 0.2 | — | — | A1/A5 = 60/40 | 5.0 |
| Thermal transfer film 12 | 0.2 | PET film with one side being corona treated (12 μm) | E4 | 0.2 | — | — | A1/A5 = 60/40 | 5.0 |
| Thermal transfer film 13 | 0.2 | PET film with one side being corona treated (12 μm) | E5 | 0.2 | — | — | A1/A5 = 60/40 | 5.0 |
| Thermal transfer film 14 | 0.2 | PET film with one side being corona treated (6 μm) | D1 | 0.2 | — | — | A5 alone | 0.1 |
| Thermal transfer film 15 | 0.2 | PET film with one side being corona treated (6 μm) | D1 | 0.2 | — | — | A5 alone | 1.5 |
| Thermal transfer film 16 | 0.2 | PET film with one side being corona treated (12 μm) | D1 | 0.2 | — | — | B1/carnauba wax = 98/2 | 6.0 |
| Thermal transfer film 17 | 0.2 | PET film with one side being corona treated (12 μm) | D1 | 0.2 | — | — | B2/carnauba wax = 98/2 | 6.0 |
| Thermal transfer film 18 | 0.2 | PET film with one side being corona treated (12 μm) | D1 | 0.2 | — | — | B3/carnauba wax = 98/2 | 6.0 |
| Thermal transfer film 19 | 0.2 | PET film with one side being corona treated (12 μm) | D1 | 0.2 | — | — | B4/carnauba wax = 98/2 | 6.0 |
| Thermal transfer film 20 | 0.2 | PET film with one side being corona treated (12 μm) | D1 | 0.2 | — | — | B5/carnauba wax = 98/2 | 6.0 |
| Thermal transfer film 21 | 0.2 | Untreated PET film (12 μm) | — | — | — | — | B3/carnauba wax = 98/2 | 6.0 |
| Thermal transfer film 22 | 0.2 | Untreated PET film (12 μm) | — | — | F3/polyethylene wax = 98/2 | 2.0 | B4 alone | 6.0 |
| Thermal transfer film 23 | 0.2 | Untreated PET film (12 μm) | — | — | F3/polyethylene wax = 98/2 | 2.0 | B3/B4 = 70/30 | 6.0 |
| Thermal transfer film 24 | 0.2 | PET film with one side being corona treated (6 μm) | D1 | 0.2 | — | — | B3/carnauba wax = 98/2 | 0.3 |
| Thermal transfer film 25 | 0.2 | PET film with one side being corona treated (6 μm) | D1 | 0.2 | — | — | B3/carnauba wax = 98/2 | 2.5 |
| Thermal transfer film 26 | 0.2 | PET film with one side being corona treated (12 μm) | D1 | 0.2 | — | — | C1/C3 = 50/50 | 6.0 |
| Thermal transfer film 27 | 0.2 | PET film with one side being corona treated (12 μm) | D1 | 0.2 | — | — | C2/C3 = 50/50 | 6.0 |
| Thermal transfer film 28 | 0.2 | PET film with one side being corona treated (12 μm) | D1 | 0.2 | — | — | C4/C3 = 50/50 | 6.0 |
| Thermal transfer film 29 | 0.2 | PET film with one side being corona treated (9 μm) | D1 | 0.2 | — | — | C1/C3/epoxy-modified silicone = 70/29/1 | 3.0 |

TABLE 5-continued

| | Coverage of backside layer, g/m² | Substrate | Thermal transfer film: Release layer Composition | Release layer Coverage, g/m² | Peel layer Composition | Peel layer Coverage, g/m² | Thermal transfer layer Composition | Thermal transfer layer Coverage, g/m² |
|---|---|---|---|---|---|---|---|---|
| Thermal transfer film 30 | 0.2 | PET film with one side being corona treated (6 μm) | D1 | 0.2 | — | — | C1/C3 = 50/50 | 1.2 |
| Thermal transfer film 31 | 0.2 | PET film with one side being corona treated (6 μm) | D1 | 0.2 | — | — | A1/A5/silica = 47/47/6 | 1.2 |
| Thermal transfer film 32 | 0.2 | PET film with one side being corona treated (6 μm) | D1 | 0.2 | — | — | C5/C6 = 75/25 (*1) | 1.2 |

(*1): Toluene/methyl ethyl ketone/n-butyl alcohol = 5/45/50 was used as dilution solvent.

Preparation of Thermal Transfer Ink Sheets 1 to 5

Thermal transfer ink sheets 1 to 5 for the formation of color images were prepared under conditions specified for each layer in Table 6.

TABLE 6

| | Coverage, g/m² | Substrate | Thermal transfer ink sheet: Composition of colored layer: Colorant | Weight ratio, % | Binder | Weight ratio, % | Other ingredient | Weight ratio, % | Coverage of colored layer, g/m² |
|---|---|---|---|---|---|---|---|---|---|
| Thermal transfer ink sheet 1 | 0.2 | Untreated PET (4.5 μm) | Aluminum pigment | 35 | Resin A5 | 65 | — | — | 1.0 |
| Thermal transfer ink sheet 2 | 0.2 | Untreated PET (4.5 μm) | Carbon black | 35 | Resin B4 | 65 | — | — | 1.0 |
| Thermal transfer ink sheet 3 | 0.2 | PET with one side being corona treated (4.5 μm) | Yellow dye (Macrolex Yellow 6G) | 40 | Polyvinyl acetal resin *1 | 59.9 | Epoxy-modified silicone | 0.1 | 1.0 |
| Thermal transfer ink sheet 4 | 0.2 | PET with one side being corona treated (4.5 μm) | Magenta dye (MS Red G) | 40 | Polyvinyl acetal resin | 59.9 | Epoxy-modified silicone | 0.1 | 1.0 |
| Thermal transfer ink sheet 5 | 0.2 | PET with one side being corona treated (4.5 μm) | Cyan dye (Boron Brilliant Blue S-R) | 40 | Polyvinyl acetal resin | 59.9 | Epoxy-modified silicone | 0.1 | 1.0 |

*1: KS-5, manufactured by Sekisui Chemical Co., Ltd.

Object

A 200 μm-thick white flexible vinyl chloride sheet or a 200 μm-thick black polycarbonate sheet was provided as an object for the evaluation of the thermal transfer films.

Examples 1 to 26 and Comparative Examples 1 to 4

In combinations specified in Table 7, a thermal transfer film A was put on top of a thermal transfer film B so that the thermal transfer layer in the thermal transfer film A faced the thermal transfer layer in the thermal transfer film B. The assembly was imagewise heated by a thermal head from the backside of the thermal transfer film A to imagewise transfer the thermal transfer layer in the thermal transfer film A onto the thermal transfer layer in the thermal transfer film B. Thus, for use in examples and comparative examples, thermal transfer films were provided wherein a thermal transfer layer having a convex was formed on a substrate so that the convex was located most remote from the substrate.

In the thermal transfer films provided with a thermal transfer layer having a convex, the thickness (height) of the convex portion in the thermal transfer layer was measured and indicated as the thickness of the convex in Table 7.

In forming the thermal transfer layer having a convex, heating was carried out by a thermal head under the following printing conditions.

In this case, a printer for evaluation was used under printing conditions of line speed 2.8 msec/line, pulse duty 80%, resolution of thermal head 300 dpi, resistance value of thermal head 1600Ω, and applied voltage 17.5 V.

TABLE 7

Thermal transfer films and evaluation results thereof

| | Thermal transfer film A | Thermal transfer film B | Ink sheet for formation of color image | Object | Image formation method | Visibility | Transferability | Abrasion resistance | Heat resistance | Thickness of convex, μm |
|---|---|---|---|---|---|---|---|---|---|---|
| Example 1 | 15 | 1 | 1 | Polycarbonate sheet | Direct transfer | ○ | ○ | ○ | ○ | 1.7 |
| Example 2 | 15 | 2 | 1 | Polycarbonate sheet | Direct transfer | ○ | ○ | ○ | ○ | 1.7 |
| Example 3 | 15 | 3 | 1 | Polycarbonate sheet | Direct transfer | ○ | ○ | ○ | ○ | 1.7 |
| Example 4 | 15 | 4 | 1 | Polycarbonate sheet | Direct transfer | ○ | ○ | ○ | ○ | 1.7 |
| Example 5 | 15 | 5 | 1 | Polycarbonate sheet | Direct transfer | ○ | ○ | ○ | ○ | 1.7 |
| Example 6 | 15 | 6 | 1 | Polycarbonate sheet | Direct transfer | ○ | ○ | ○ | ○ | 1.7 |
| Example 7 | 15 | 7 | 1 | Polycarbonate sheet | Direct transfer | ○ | ○ | ○ | ○ | 1.7 |
| Example 8 | 15 | 8 | 1 | Polycarbonate sheet | Direct transfer | ○ | ○ | ○ | ○ | 1.7 |
| Example 9 | 15 | 9 | 1 | Polycarbonate sheet | Direct transfer | ○ | ○ | ○ | ○ | 1.7 |
| Example 10 | 15 | 10 | 1 | Polycarbonate sheet | Direct transfer | ○ | ○ | ○ | ○ | 1.7 |
| Example 11 | 15 | 11 | 1 | Polycarbonate sheet | Direct transfer | ○ | ○ | ○ | ○ | 1.7 |
| Example 12 | 15 | 12 | 1 | Polycarbonate sheet | Direct transfer | ○ | ○ | ○ | ○ | 1.7 |
| Example 13 | 15 | 13 | 1 | Polycarbonate sheet | Retransfer | ○ | ○ | ○ | ○ | 1.7 |
| Example 14 | 24 | 16 | 2 | Vinyl chloride sheet | Direct transfer | ○ | ○ | ○ | ○ | 0.3 |
| Example 15 | 25 | 17 | 2 | Vinyl chloride sheet | Direct transfer | ○ | ○ | ○ | ○ | 2.7 |
| Example 16 | 24 | 18 | 2 | Vinyl chloride sheet | Direct transfer | ○ | ○ | ○ | ○ | 0.3 |
| Example 17 | 25 | 19 | 2 | Vinyl chloride sheet | Direct transfer | ○ | ○ | ○ | ○ | 2.7 |
| Example 18 | 24 | 20 | 2 | Vinyl chloride sheet | Direct transfer | ○ | ○ | ○ | ○ | 0.3 |
| Example 19 | 25 | 21 | 2 | Vinyl chloride sheet | Retransfer | ○ | ○ | ○ | ○ | 2.7 |
| Example 20 | 24 | 22 | 2 | Vinyl chloride sheet | Direct transfer | ○ | ○ | ○ | ○ | 0.3 |
| Example 21 | 25 | 23 | 2 | Vinyl chloride sheet | Direct transfer | ○ | ○ | ○ | ○ | 2.7 |
| Example 22 | 30 | 26 | 2 | Vinyl chloride sheet | Direct transfer | ○ | ○ | ○ | ○ | 1.3 |
| Example 23 | 30 | 27 | 2 | Vinyl chloride sheet | Direct transfer | ○ | ○ | ○ | ○ | 1.3 |
| Example 24 | 30 | 28 | 3, 4, 5 | Vinyl chloride sheet | Direct transfer | ○ | ○ | ○ | ○ | 3.3 |
| Example 25 | 29 | 29 | 3, 4, 5 | Vinyl chloride sheet | Retransfer | ○ | ○ | ○ | ○ | 3.3 |
| Example 26 | 31 | 1 | 1 | Polycarbonate sheet | " | ◎ | ○ | ○ | ○ | 1.0 |
| Example 27 | 32 | 26 | 1 | Vinyl chloride sheet | " | ◎ | ○ | ○ | ○ | 1.0 |
| Comparative Example 1 | 14 | 1 | 1 | Polycarbonate sheet | Direct transfer | X | ○ | ○ | ○ | 0.1 |
| Comparative Example 2 | 2 | 2 | 1 | Vinyl chloride sheet | Direct transfer | ○ | ○ | ○ | ○ | 7.6 |

TABLE 7-continued

Thermal transfer films and evaluation results thereof

| | Thermal transfer film A | Thermal transfer film B | Ink sheet for formation of color image | Object | Image formation method | Visibility | Transferability | Abrasion resistance | Heat resistance | Thickness of convex, μm |
|---|---|---|---|---|---|---|---|---|---|---|
| Comparative Example 3 | 1 (except that A5 was changed to A6) | 1 (except that A5 was changed to A6) | 1 | Polycarbonate sheet | Direct transfer | ○ | ○ | X | X | 4.3 |
| Comparative Example 4 | 16 (except that B1 was changed to B6) | 16 (except that B1 was changed to B6) | 1 | Vinyl chloride sheet | Direct transfer | ○ | X | ○ | ○ | 6.5 |

Method for Formation of Color Image and Non-color Image (Direct Transfer Method)

An object and the thermal transfer ink sheet were put on top of each other so that one side of the object faced the colored layer in the thermal transfer ink sheet. The thermal transfer ink sheet was imagewise heated from the backside thereof by means of a thermal head to imagewise transfer the colorant alone or a combination of the colorant with the binder onto the object, whereby a color image was formed directly on the object (for the thermal transfer ink sheets 1 and 2, the colorant and the binder were transferred onto the object while, for the thermal transfer ink sheets 3, 4, and 5, only the colorant was transferred onto the object). Thereafter, the object with the color image formed thereon and the thermal transfer film provided with a thermal transfer layer having a convex prepared by the above method were put on top of each other so that the image formed face in the object faced the thermal transfer layer in the thermal transfer film. In this state, the whole area of the thermal transfer film was then heated from the backside of the thermal transfer film by means of a heat roll covered with rubber heated at 180° C. to transfer the whole area of the thermal transfer layer in the thermal transfer film onto the object. Thus, a non-color image was formed on the object.

In this case, the color image was printed under the same conditions as used in the preparation of the thermal transfer film provided with a thermal transfer layer having a convex.

Method for Formation of Color Image and Non-color Image (Retransfer Method)

The thermal transfer film provided with a thermal transfer layer having a convex prepared by the above method and the thermal transfer ink sheet were put on top of each other so that the thermal transfer layer in the thermal transfer film faced the colored layer in the thermal transfer ink sheet. In this state, the thermal transfer ink sheet was then imagewise heated from the backside thereof by means of a thermal head to imagewise transfer the colorant alone or a combination of the colorant with the binder onto the thermal transfer layer in the thermal transfer film, whereby a color image was formed on the thermal transfer layer in the thermal transfer film. Thereafter, an object and the thermal transfer film provided with a thermal transfer layer having thereon a color image were put on top of each other so that the object faced the thermal transfer layer in the thermal transfer film. In this state, the whole area of the thermal transfer film was then heated from the backside thereof by means of a heat roll covered with rubber heated at 180° C. to transfer the whole area of the thermal transfer layer in the thermal transfer film. Thus, a color image and a non-color image were formed on the object.

In this case, the color image was printed under the same conditions as used in the preparation of the thermal transfer film provided with a thermal transfer layer having a convex.

In Examples 1 to 25 and Comparative Examples 1 to 4, the thermal transfer film provided with a thermal transfer layer having a convex provided in each example, the thermal transfer ink sheet for color image formation, and the object were used in combination as specified in Table 7. Further, the color image and the non-color image were formed on the object by the method as specified in Table 7.

The object with a color image and a non-color image formed thereon and the thermal transfer film provided with a thermal transfer layer having a convex were evaluated as follows.

Visibility of Non-color Convex Image

The thermal transfer layer in the thermal transfer film A was transferred in the form of a letter "ABC" having a size of 7 point onto the thermal transfer layer in the thermal transfer film B to prepare a thermal transfer film provided with a thermal transfer layer having a convex for use in evaluation. A non-color image and a color image were formed on the object by the above method using this thermal transfer film provided with a thermal transfer layer having a convex, and the legibility of the letter "ABC" was evaluated.

Transferability

The object with a non-color image and a color image formed thereon by the above method was visually inspected for the following items to evaluate the transferability.

Transfer failure (a part of the thermal transfer layer in the thermal transfer film was not transferred)

Tailing (the thermal transfer layer transferred onto the object was projected from the end of the object)

Abrasion Resistance

The object with a non-color image and a color image formed thereon was subjected to a 200-revolution abrasion resistance test with a TABER tester using a truck wheel CS-10F under a load of 500 gf, and the object was then inspected for the loss of the color image.

Heat Resistance

The thermal transfer films were put on top of each other so that the thermal transfer layer in one of the thermal transfer films faced the backside layer in the other thermal transfer film. The assembly was stored at 50° C. for two days and was then inspected for blocking.

The results of evaluation for the examples and the comparative examples were as shown in Table 7.

For the visibility of the convex as the non-color image, as compared with the image formed objects prepared in Examples 1 to 24, the image formed objects prepared in Examples 25 and 26 were slightly opaque and translucent in its convex portion and, since the thermal transfer layer in its portion adjacent to the convex was transparent, the light transmittance of the convex was different from the light transmittance of the thermal transfer layer in its portion adjacent to the convex, rendering the convex conspicuous.

What is claimed is:

1. A thermal transfer film comprising:

a substrate; and at least one layer including a thermal transfer layer provided on one aide of the substrate, the thermal transfer layer being located on the uppermost surface of the thermal transfer film, wherein a convex is provided on a part of the thermal transfer layer.

2. The thermal transfer film according to claim 1, wherein the thermal transfer layer comprises as a main component a thermoplastic resin having a glass transition temperature of 50 to 120° C.

3. The thermal transfer film according to claim 2, wherein the thermoplastic resin is selected from a polyester resin having a number average molecular weight of 2000 to 30000, a vinyl chloride-vinyl acetate copolymer having an average degree of polymerization of 150 to 500, and a homopolymer or copolymer, of a methacrylate base monomer, having a weight average molecular weight of 20000 to 60000.

4. The thermal transfer film according to claim 1, wherein a release layer is provided between the substrate, and the thermal transfer layer so as not to be separable from the substrate side.

5. The thermal transfer film according to claim 4, wherein a peel layer is provided between the substrate and the thermal transfer layer so as to be separable from the substrate side.

6. The thermal transfer film according to claim 5, wherein the peel layer is provided between the release layer and the thermal transfer layer.

7. The thermal transfer film according to claim 1, wherein the convex has a height of 0.2 to 5.0 $\mu$m.

8. The thermal transfer film according to claim 1, wherein the thermal transfer layer is transparent.

9. A process for producing a thermal transfer film comprising a substrate; and at least one layer including a thermal transfer layer provided on one side of the substrate, the thermal transfer layer being located on the uppermost surface of the thermal transfer film, wherein a convex is provided on a part of the thermal transfer layer, said process comprising the steps of:

providing two thermal transfer films each comprising a substrate and at least one layer including a thermal transfer layer provided on the substrate, the thermal transfer layer being located on the uppermost surface of the thermal transfer film;

putting the two thermal transfer films on top of each other so that the thermal transfer layer in one of the thermal transfer films faces the thermal transfer layer in the other thermal transfer film; and partially heating the assembly of the thermal transfer films to transfer a part of the thermal transfer layer in one of the thermal transfer films onto the thermal transfer layer in the other thermal transfer film, whereby a convex is formed on a part of the thermal transfer layer in one of the thermal transfer films.

10. A method for image formation using a thermal transfer film comprising a substrate; and at least one layer including a thermal transfer layer provided on one side of the substrate, the thermal transfer layer being located on the uppermost surface of the thermal transfer film, wherein a convex is provided on a part of the thermal transfer layer, said method comprising the steps of:

putting the thermal transfer film on top a thermal transfer recording medium comprising a substrate and, provided on at least one side of the substrate, a thermal transfer ink layer comprising a thermoplastic resin and a colorant so that the thermal transfer layer faces the thermal transfer ink layer;

imagewise heating the stacked thermal transfer recording medium to imagewise transfer the thermal transfer ink layer or the colorant onto the thermal transfer layer in the thermal transfer film, whereby a reverse image is once formed on the thermal transfer film;

then putting the thermal transfer film with the reverse image formed thereon on top of an object so that the thermal transfer layer in the thermal transfer film faces an image forming face in the object; and heating the stacked thermal transfer film from the surface thereof remote from the thermal transfer layer to transfer the thermal transfer layer with the reverse image formed thereon onto the object, whereby an image is formed on the object.

11. The method according to claim 10, wherein the thermal transfer layer is transparent or translucent.

12. The method according to claim 10, wherein the light transmission property of the convex formed in the thermal transfer layer is different from the light transmission property of the thermal transfer layer in its portion other than the convex.

13. An image formed object comprising an image formed by the method according to claim 10.

* * * * *